United States Patent [19]

Luckenbach

[11] 4,062,761

[45] Dec. 13, 1977

[54] METHOD FOR VARYING THE CATALYST CIRCULATION RATE IN A FLUID CATALYTIC CRACKING PROCESS

[75] Inventor: Edward C. Luckenbach, Mountainside, N.J.

[73] Assignee: Exxon Research and Engineering Company, Linden, N.J.

[21] Appl. No.: 636,207

[22] Filed: Nov. 28, 1975

[51] Int. Cl.[2] ..... C10G 11/18

[52] U.S. Cl. ..... 208/164; 23/288 S; 208/DIG. 1

[58] Field of Search ..... 208/164, DIG. 1

[56] References Cited

U.S. PATENT DOCUMENTS

| | | | |
|---|---|---|---|
| 2,589,124 | 3/1952 | Packie | 208/164 |
| 2,595,909 | 5/1952 | Trainer et al. | 208/164 |
| 2,763,601 | 9/1956 | Martin et al. | 208/164 |
| 2,781,234 | 2/1957 | Boisture et al. | 208/164 |
| 2,902,432 | 9/1959 | Codet et al. | 208/164 |
| 3,316,170 | 4/1967 | Stewart et al. | 208/164 |
| 3,494,858 | 2/1970 | Luckenbach | 208/164 |

*Primary Examiner*—Herbert Levine

*Attorney, Agent, or Firm*—John W. Ditsler

[57] ABSTRACT

The catalyst circulation rate in a fluid catalytic cracking process is regulated by using a low pressure drop valve means in the spent catalyst circuit of said process in conjunction with a control riser in said circuit. More particularly, a reduced catalyst circulation rate may be obtained in a fluid catalytic cracking process, the spent catalyst circulation rate in said process being controlled by the injection of variable amounts of a control gas into the control riser so as to cause density variations therein, by employing a low pressure drop valve means in the spent catalyst circuit of said process such that the pressure drop across said valve means reduces the pressure drop across the riser and consequently the density within said riser. The reduction in density within the riser results in a lowering of the catalyst circulation rate. Use of the present invention enables stable operation of the catalyst circuit at circulation rates equivalent to lower mass velocities in the riser than possible without the low pressure drop valve means while maintaining the pressure differential between the regeneration zone and the cracking zone substantially constant.

4 Claims, 1 Drawing Figure

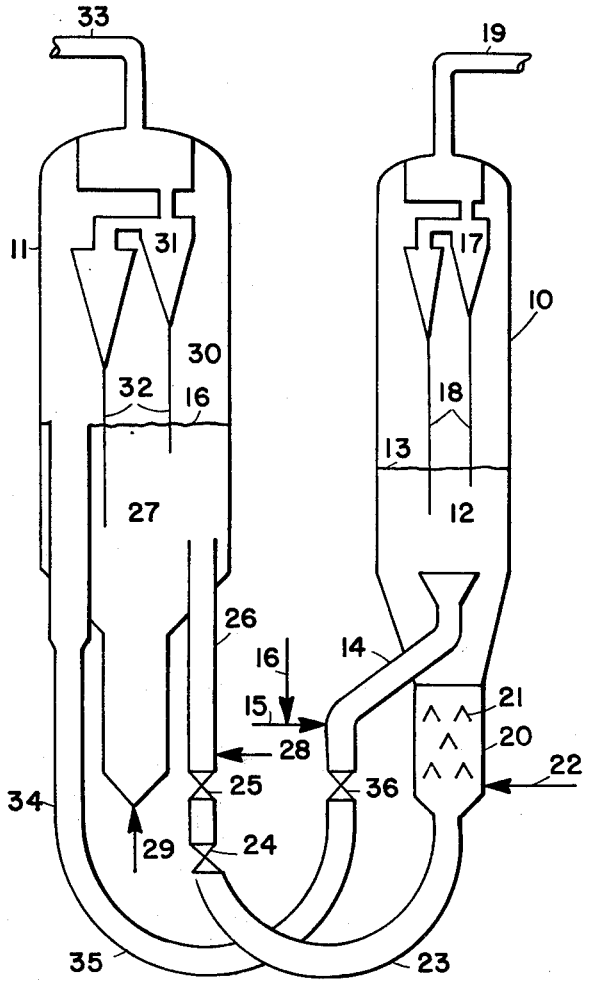
33
19
11
31
17
10
30
32
16
18
13
27
12
26
16
14
15
21
28
20
22
25
36
34
29
24
35
23

METHOD FOR VARYING THE CATALYST CIRCULATION RATE IN A FLUID CATALYTIC CRACKING PROCESS

BACKGROUND OF THE INVENTION

1. Field of the Invention

This invention relates to an improved method for controlling a catalytic hydrocarbon conversion process. More particularly, this invention relates to a method for controlling the catalyst circulation rate in a fluid catalytic cracking process by employing a low pressure drop valve means in the spent catalyst circuit in conjunction with a control riser.

2. Description of the Prior Art

The fluidized catalytic cracking of hydrocarbons in well known in the prior art and may be accomplished in a variety of processes which employ fluidized solid techniques. Normally in such processes, suitably preheated, relatively high molecular weight hydrocarbon liquids and/or vapors are contacted with hot, finely divided, solid catalyst particles either in a fluidized bed reactor or in an elongated riser reactor and maintained at an elevated temperature in a fluidized state for a period of time sufficient to effect the desired degree of cracking to the lower molecular weight hydrocarbons typical of those present in motor gasolines and distillate fuels.

During the cracking reaction, coke is deposited on the catalyst particles in the cracking zone thereby reducing the activity of the catalyst for cracking and the selectivity of the catalyst for producing gasoline blending stock. In order to restore a major portion of activity to the coke contaminated or spent catalyst, the catalyst is transferred from a cracking zone into a regeneration zone wherein the catalyst is contacted with an oxygen-containing regeneration gas, such as air, under conditions sufficient to burn at least a portion, preferably a substantial portion, of the coke from the catalyst. The regenerated catalyst is subsequently withdrawn fron the regeneration zone and reintroduced into the cracking zone for reaction with additional hydrocarbon feedstock.

In commercial catalytic cracking units, good control of the circulating catalyst stream is essential for economic operation. Erratic flow causes fluctuations in the quality of the regenerated catalyst, the catalyst/oil ratio, the catalyst inventory in the cracking zone and the temperature of the cracking zone — all of which have important effects on the product yields and on the feed capacity of the unit. In general, the catalyst circulation rate in present catalytic cracking units is controlled by using slide valves or other similar devices in the catalyst circulation lines (see, for example, U.S. Pat. Nos. 2,593,339; 3,001,931; 3,033,780; 3,769,203; 3,847,793) or by using a dynamic pressure balance control system such as is described in U.S. Pat. No. 2,589,124. The present invention is primarily concerned with an improvement in the method described in U.S. Pat. No. 2,589,124, the disclosure of which is incorporated herein by reference.

According to U.S. Pat. No. 2,589,124, cracking catalyst is circulated between the cracking zone and the regeneration zone without the use of control slide valves. Rather, the rate of flow of solids between the two zones is regulated by controlling the density of the catalyst suspension in a control riser leading to the regeneration zone. The change in density may be effected by injecting variable amounts of a control gas, such as air, into the control riser. Since the pressures at the top and bottom of the control riser correspond substantially to the pressures of the regeneration zone and cracking zone, respectively, the change of density within the riser must be compensated for by a change in the mass velocity of the catalyst stream flowing therein. However, control gas velocities in the riser which permit stable control of the catalyst circulation rate therein are limited to a fairly narrow range, i.e., from between about 6 to about 15 ft./second. For example, at control gas velocities of less than about 6 ft./second, large bubbles, i.e., slugs of gas, form in the riser which adversely affect the stability of catalyst flow. At control gas velocities of greater than about 15 ft./second, the frictional pressure drop of the catalyst stream flowing therein increases with increased gas velocity as fast as the pressure drop resulting from the lower static head due to the dilution of the catalyst by additional gas is reduced. Thus, there is relatively little change in the catalyst circulation rate. In fact, the catalyst circulation can become "choked" resulting in a lower catalyst circulation rate at increased gas velocities.

In either of the methods for controlling catalyst circulation rate mentioned above, the circulation rate can also be varied by shifting the pressure balance between the regeneration zone and the cracking zone, i.e., the regeneration zone pressure can be raised or the cracking zone pressure can be reduced, while maintaining the flow of gas into the control riser in a range which provides stable catalyst flow. However, an increase in regeneration zone pressure will require an increase in utility consumption since the blower supplying the regeneration gas to the regeneration zone must compensate for the increased pressure. Similarly, if the pressure of the cracking zone were reduced, the requirements of the compressor associated with light ends recovery of the vapor stream from the fractionation zone distillate drum will be increased.

Thus, it would be desirable to have available a simple, economical method to control the catalyst circulation rate of a fluid catalytic cracking process wherein the disadvantages presently associated with the prior art are eliminated.

SUMMARY OF THE INVENTION

Now, according to the present invention, in a fluid catalytic cracking process wherein the catalyst circulation rate is regulated by injecting variable amounts of a control gas into a control riser located in the spent catalyst circuit, i.e., the circuit wherein coke contaminated or spent catalyst is transferred from the cracking zone to the regeneration zone, a low pressure drop valve means is used in said spent catalyst circuit to vary the pressure drop across the control riser and, therefore, the density of the catalyst mixture therein. The variation in density within the control riser causes a variation of the catalyst circulation rate. This result is obtained while maintaining the pressure differential between the regeneration zone and the cracking zone substantially constant. If the variation is such as to cause a reduction in pressure drop across the control riser and hence a reduction in the catalyst circulation rate, in the absence of the low pressure drop valve means, gas velocities in the control riser would have to be reduced to levels such that unstable catalyst flow will occur. Thus, this invention provides a novel method for extending, e.g., lowering, the range of catalyst circulation rates over which stable flow can be maintained.

The low pressure drop valve means referred to herein is designed to provide a pressure drop in an amount less than 4 psi, preferably in the range of from about 0.3 to about 3 psi, and more preferably in the range of from about 1 to about 3 psi. The low pressure drop across the valve means also minimizes erosion of same. In a preferred embodiment, the valve means is a slide valve that contains an aperture in the slide such that catalyst circulation does not cease when the valve is fully closed.

BRIEF DESCRIPTION OF THE DRAWING

The single FIGURE diagrammatically depicts one form of a fluid catalytic cracking process suitable for practicing the present invention.

DETAILED DESCRIPTION OF THE INVENTION

Having thus described the invention in general terms reference is now made to the FIGURE. It is to be understood that the FIGURE is shown only for the purpose of illustrating a typical fluid catalytic cracker configuration. Such details are included as are necessary for a clear understanding of how the present invention may be applied to said system. No intention is made to unduly limit the scope of the present invention to the particular configuration shown as other configurations are contemplated. Various items such as pumps, compressors, steam lines, instrumentation and other process equipment and control means have been omitted therefrom for the sake of simplicity. Variations obvious to those having ordinary skill in the art of fluid catalytic cracking processes are included within the broad scope of the present invention.

Referring now to the FIGURE, the system illustrated includes a vertically arranged cylindrical cracking zone 10 and a regeneration zone 11. The cracking zone 10 contains a fluidized bed 12 of catalyst having a level indicated at 13. A hydrocarbon feedstock is introduced into transfer line 14 at line 15 and is contacted with the regenerated cracking catalyst present therein. The feedstock may be heated by conventional means so that at least a portion thereof will be vaporized prior to entering the cracking zone. Any portion of the feedstock not vaporized prior to entering the cracking zone will be fully vaporized by the heat supplied by the catalyst in the cracking zone. An auxiliary stream 16 is normally added to aid in vaporizing and dispersing the feed. The catalyst and the feedstock are mixed to form a suspension comprising hydrocarbon vapors and catalyst particles which passes upwardly through transfer-line 14 such that the feedstock undergoes cracking to form a vaporous stream comprising unreacted feedstock, reacted feedstock containing both saturated and unsaturated materials, steam and the like. The vaporous stream passes upward through the fluid bed 12 and maintains said bed in a dense turbulent fluidized condition having the appearance of a boiling liquid. As the feedstock is cracked, coke is deposited on the catalyst particles present therein, thereby reducing activity of the catalyst for cracking and the selectivity of the catalyst for producing desirable gasoline blending stock. The coke content of the coke contaminated or spent catalyst can vary from about 0.5 to about 5 wt. % or more, typically from about 0.5 to about 1.5 wt. %. It should be noted that the term "spent catalyst" is actually a misnomer since coke contaminated catalyst still possesses some catalytic activity. The coke contaminated catalyst and the vapors present in the cracking zone, i.e., predominantly hydrocarbon vapors formed during the cracking reaction, pass from fluid bed 12 into a catalyst separation means 17, wherein at least a portion and preferably a substantial portion, i.e., at least 80%, preferably at least 95%, and more preferably at least 99%, of the coke contaminated catalyst is separated from said vapors so as to form a substantially catalyst-free vaporous effluent stream and a coke contaminated catalyst stream. The coke contaminated catalyst is returned to fluid bed 12 via diplegs 18. The cracked products are then conveyed from the catalyst separation means 17 via line 19 to a product recovery zone, e.g., a fractionation zone. The fractionation zone (not shown) can be a plurality of fractional distillation zones suitably equipped with all auxiliary equipment usually associated with commercial distillation towers. This equipment includes, for example, internal vapor-liquid contact means, cooling and condensing means, means for inducing reflux, and heating or cooling means and the like in the bottom of the zone. The various cracked products are separated within the fractionation zone and are then passed to recovery. If desired, intermediate and heavy fractions thus obtained can be recycled to the transfer-line cracking zone.

Coke contaminated catalyst to be regenerated is discharged from cracking zone 10 and passed downward through stripping zone 20. The stripping zone is usually provided with stripper sheds 21 or some other suitable means such as disc or donut shape baffles which separate downwardly flowing coke contaminated catalyst from any volatile components present thereon, e.g., residual hydrocarbons, by means of upwardly flowing stripping steam or other stripping gas such as nitrogen, other inert gases or flue gas which is introduced into the bottom of the stripping zone via line 22. The stripped, coke contaminated catalyst is withdrawn from the bottom of stripping zone 20 and is passed sequentially through U-bend 23, conventional shut-off valve 24, low pressure drop valve means 25, and into control riser 26 which extends into the lower portion of the regeneration zone 11. Although not necessary to the practice of the present invention, the control riser is normally in the substantially vertical position as shown in the Figure. The control riser 26 terminates within the dense phase catalyst bed 27 which is undergoing regeneration to burn-off deposits formed in the cracking zone 10. The coke deposits may be graphitic in nature or hydrocarbon components of low hydrogen content. The hydrocarbon components comprise heavy molecular weight components of the feedstock, condensation products from the cracking reaction or unstripped light materials which were not removed completely in the stripping zone. A control gas such as air is added via line 28 in a quantity sufficient to reduce the density of the catalyst flowing in riser 26, thus causing the catalyst to flow upward into the regeneration zone 11 by simple hydraulic balance.

The regeneration zone 11 is typically a large vertical cylindrical vessel, shown here as arranged at approximately the same level as cracking zone 10, into which an oxygen-containing regeneration gas such as air is introduced via line 29 and passed upward through the dense phase catalyst bed 27, maintaining it in a turbulent fluidized condition similar to that of fluid bed 12. Flue gas formed during regeneration of the coke contaminated catalyst is passed from the dense phase catalyst bed 27 into a dilute catalyst phase 30 along with entrained particles of regenerated catalyst. The regenerated catalyst particles are separated from the flue gas by catalyst separation means 31 and returned to the dense phase catalyst bed 27 via diplegs 32. The substantially catalyst-free flue gas resulting from said separation is discharged from regeneration zone 11 via line 33. Regenerated catalyst from the dense phase catalyst bed 27 in the regeneration zone 11 flows downward through standpipe 34 and passes through U-bend 35 and conventional shut-off valve 36 into the cracking zone 10 by way of transfer-line 14, which joins U-bend 35 at the level of the oil injection line 15 above the U-bend. Typically the regenerated catalyst leaving the regeneration zone has a low residual carbon content, e.g., less than 0.3 wt. %. Preferably the carbon content of the regenerated catalyst ranges from about 0.01 to about 0.2 wt. %.

The use of low pressure drop valve means 25 in the spent catalyst circuit of a fluid catalytic process wherein the catalyst circulation rate is regulated by injecting variable amounts of control gas via line 28 into control riser 26, thus causing a density variation therein, provides a means for expanding the range over which said catalyst circulation rate can be operated stably. In the FIGURE, the valve means must be located in the spent catalyst circuit because there is no device present in the regenerated catalyst circuit to control the catalyst circulation rate via density change, i.e., no control riser, without shifting the pressure differential between the cracking zone and the regeneration zone or varying the control air rate. Although the low pressure drop valve means 25 may be placed at any particular location in the spent catalyst circuit, it is preferably located prior to the control riser and in that portion of the spent catalyst circuit wherein the catalyst is in upward flow. If located in a portion of the circuit wherein the catalyst is in downward flow, bubbles of the gas that are fluidizing the catalyst stream may be trapped immediately downstream of valve 36 as the velocity of the circulating catalyst is insufficient to transport all of the fluidizing gas to the regeneration zone if the catalyst flow rate is low, thus making the establishment of good flow distribution more difficult. Thus, placement of the low pressure drop valve means in that portion of the spent catalyst circuit wherein the catalyst is in upward flow provides for a more uniform flow of solids in the circuit since the possibility of fluctuations in pressure due to deaeration in the line is reduced. In the upward flowing portion of the spent catalyst circuit, the low pressure drop valve means is preferably located subsequent to conventional shut-off valve 36 and prior to the control gas injection point (line 28 in the FIGURE) to prevent contacting of said control gas with hydrocarbon in the cracking zone during periods of emergency pressure fluctuations.

Low pressure drop valve means 25 may be any valve suitable for use in fluid/solids systems, e.g., a slide valve, butterfly valve and the like. Preferably, a slide valve will be employed. Although not necessary to the practice of the present invention, it is preferred that the valve contain an aperture therein such that catalyst circulation will continue when the valve is fully closed. While the aperture may be of any convenient configuration, it is preferably shaped to produce a symmetrical distribution of catalyst velocities in the control riser downstream of the valve to minimize channeling of the catalyst near the walls of the control riser.

According to the present invention, low pressure drop valve means 25 will absorb at least a portion of the pressure drop normally present across the control riser 26 and thereby enable a stable operation of the catalytic cracking processes described above at a reduced catalyst circulation rate. Should the pressure drop across valve means 25 be a large portion of that normally present across riser 26, the ability to control the catalyst circulation rate by density variation due to changes in control gas rate, i.e., changes in density, would be reduced. In the extreme, a large pressure drop across valve means 25, i.e., a small pressure drop across control riser 26, approaches the purely slide valve method for controlling catalyst circulation rate mentioned above because there would be little flexibility to change density resulting from variations in control gas rate. Thus, in accordance with the present invention, the pressure drop across valve means 25 should be maintained in an amount less than 4 psi and preferably in the range of from about 1 to about 3 psi. At this low pressure drop, erosion of the valve means will be minimized.

Use of the low pressure drop valve means as described above causes a variation in the pressure drop across the control riser and a consequent variation in the density of the catalyst suspension within said riser. If the variation causes a reduction in pressure drop across the control riser, i.e., a reduction in catalyst density within said riser, and the pressures of the regeneration zone and cracking zone are maintained substantially constant, the static head across the control riser must be reduced. This reduction in static head is achieved by the reduction in density in the riser and must be a result of a reduction in the mass velocity, i.e., the catalyst circulation rate, through the riser assuming the control gas rate is maintained substantially constant. The change in catalyst circulation rate with pressure drop across the valve means is dependent upon the frictional pressure drop in the riser, the length of the riser and the like. Thus, based upon the specific design and configuration, one skilled in the art can readily calculate the change in circulation rate with pressure drop across the valve means.

Thus, by use of this invention, the catalyst circulation rate, i.e., the mass velocity of the catalyst mixture in the riser, can be reduced without changing the pressure differential between the regeneration zone and cracking zone which normally is maintained between 1–2 psi. In addition, stable catalyst circulation rates equivalent to very low mass velocities, e.g., mass velocities as low as about 10 pounds per second per square foot, can be maintained in the control riser at control gas velocities normally employed in catalytic cracking processes, i.e., gas velocities ranging from about 6 to about 10 feet per second in said riser. In contrast, typical mass velocities in the control riser range from about 50 to 100 pounds per second per square foot at the normal control gas velocities mentioned above. In the absence of the low pressure drop valve, the control gas velocities would have to be reduced to less than 6 feet per second to achieve the low mass velocities e.g., 10–30 pound per second per square foot, obtained using the present invention. This would result in unstable catalyst flow.

Since the temperature in the regeneration zone increases with a reduction in the catalyst circulation rate (in general, the temperature is directly proportional to changes in catalyst circulation rate), the present invention has particular application as a method of achieving so-called "high temperature regeneration" wherein catalyst regeneration is conducted at temperatures of up to 1400° F or more. Regeneration at such elevated temperatures is desirable because the regenerated catalyst leaving the regeneration zone has a very low residual carbon content, i.e., less than 0.2 wt. % and preferably in the range of from about 0.01 to 0.1 wt. %, more preferably in the range of 0.01 to 0.05 wt. %. A regenerated catalyst having such low residual carbon content generally possesses enhanced activity and selectivity characteristics more closely associated with those of fresh cracking catalyst. Accordingly, higher conversions of feedstock and product yields of desirable conversion products may be obtained. In addition, the carbon monoxide content of the substantially catalyst-free flue gas discharged from the regeneration zone can be maintained at less than about 0.1 vol. % and preferably less than 0.05 vol. %. This low level of carbon monoxide permits the direct release of said flue gas to the atmosphere while meeting present ambient air quality standards. This added advantage permits the elimination of capital expenditures otherwise required for installation of boilers for the combustion of carbon monoxide.

The catalytic cracking process referred to herein may be of any particular configuration provided the catalyst circulation rate is regulated via density changes in an apparatus functioning similar to that of the control riser mentioned above. Since the fluid catalytic cracking process is well known in the art and has been described extensively in the literature, typical operating conditions are summarized below:

| Regeneration Zone | Suitable | Preferred |
|---|---|---|
| Temperature, ° F | 1150–1400 | 1250–1320 |
| Pressure, psig | 10–70 | 15–30 |
| Catalyst Density, lb/ft³ | | |
| Dense Phase Bed | 8–30 | 12–18 |
| Dilute Catalyst Phase | 0.1–5 | 0.5–1.5 |
| Residence time of Catalyst, minutes | 1–6 | 2–4 |
| Cracking zone | | |
| Transfer-line | | |
| Temperature, ° F | 800–1150 | 950–1100 |
| Pressure, psig | 8–60 | 15–45 |
| Catalyst Density, lb/ft³ | 0.5–5 | 1–3 |
| Gas Velocity, ft/sec | 6–75 | 8–60 |
| Catalyst/Oil weight ratio | 6–30 | 6–12 |
| Space Velocity, lbs of hydrocarbon/hr per lb of catalyst hold-up | 10–300 | 20–150 |
| Dense Bed | | |
| Temperature, ° F | 800–1100 | 950–1100 |
| Pressure, psig | 10–20 | 15–30 |
| Catalyst density, lb/ft³ | | |
| Dense phase bed | 7–35 | 12–16 |
| Dilute catalyst phase | 0.3–5 | 1–2 |
| Space Velocity | 2–20 | 5–10 |

Transfer-line cracking zones, such as those described in U.S. Pat. No. 3,687,841, the disclosure of which is incorporated herein by reference, may also be employed as shown above.

The catalytic cracking process referred to herein can treat a wide variety of hydrocarbon feedstocks. Such feedstocks are generally well known and include naphthas, light gas oils, heavy gas oils, wide cut gas oils, vacuum gas oils, kerosenes, decanted oils, residual fractions, reduced crude oils, cycle oils derived from any of these, as well as suitable fractions derived from shale oil kerogen, tar sands bitumen processing, synthetic oils, coal hydrogenation, and the like. Generally, the catalytic cracking process of this invention is concerned with feedstocks boiling in the range of from about 100° to about 1300° F. Such fractions may be employed singly, separately in parallel cracking zones, or in any desired combination.

In general, any commercial catalytic cracking catalyst would be suitable for use in the present catalytic cracking zone. Suitable catalysts include those containing silica and/or alumina. Other refractory metal oxides such as magnesia or zirconia may be employed limited only by their ability to be effectively regenerated under the selected conditions. With particular regard to catalytic cracking, preferred catalysts include the combinations of silica and alumina, containing 10 to 50 wt. % alumina, and particularly their admixtures with molecular sieves or crystalline alumino-silicates. Admixtures of clay-extended aluminas may also be employed. Such catalysts may be prepared by any suitable method such as by impregnation, milling, co-gelling, and the like, subject only to provision of the finished catalyst in a physical form capable of fluidization.

Suitable molecular sieves include both naturally occurring and synthetic aluminosilicate materials, such as faujasite, chabazite, X-type and Y-type aluminosilicate materials and ultra stable, large pore crystalline alumino-silicate materials. The fundamental structure of the molecular sieves comprises silicon and aluminum atoms that are tetrahedrally coordinated with four oxygen atoms. The valance charges (+3) of the aluminum atom are not balanced by the four coordinated oxygen atoms so that there is a net negative charge of the alumina tetrahedra. These charges are balanced by cations, generally sodium or potassium, interspersed within the structure. All or a portion of the cations can be replaced with hydrogen ions, aluminum ions or metal cations, rare earth, manganese, cobalt, zinc and other metals of Groups I through VIII of the Periodic Table. When admixed with, for example, silica-alumina to provide a petroleum cracking catalyst, the molecular sieve content of the fresh finish catalyst particles is suitably within the range from 5–15 wt. %, preferably 8–10 wt. %. An equilibrium molecular sieve cracking catalyst may contain as little as about 1 wt. % crystalline material.

The regeneration gas and control gas employed herein are gases which contain molecular oxygen in admixture with a substantial portion of an inert diluent gas. Air is a particularly suitable gas. Additional gases which may be employed include enriched air, and oxygen in combination with carbon dioxide, other inert gases, or both.

One or more separation means may comprise the catalyst separation means referred to herein. It may be desirable, however, to employ a rough cut cyclone as the first stage separation means wherein a rough separation is made between the catalyst and the vaporous effluent upon contact with a plate or cap, thereby causing the bulk of the catalyst to be separated therefrom by centrifugal force. Preferred catalyst separation means include cyclone separators, multiclones, and the like whose design and construction are well known in the art. In the case of cyclone separators, a single cyclone may be used. Preferably, however, more than one cyclone separator will be used in parallel or in series flow to effect the desired degree of separation. As used herein, the term "substantially catalyst-free vaporous effluent stream" refers to the vaporous effluent from the catalyst separation means from which entrained catalyst particles have been substantially removed. This corresponds to a vaporous effluent wherein the concentration of entrained catalyst particles will be less than about 0.5, preferably less than about 0.1, grains per actual cubic foot. The term "actual cubic foot" refers to the volume measured at actual operating conditions without correction to a standard temperature and pressure.

The construction of the regeneration and cracking zones can be made with any material sufficiently able to withstand the relatively high temperatures involved and the high erosive conditions which are inherent in systems wherein fluidized catalyst is transported. Specifically metals are contemplated which may or may not be lined. The use of ceramic liners are contemplated within any and all portions of said zones together with alloy and structural designs to withstand temperatures of about 1400° F or greater.

What is claimed is:

1. In a fluid catalytic cracking process which comprises contacting a hydrocarbon feedstock with a cracking catalyst in a cracking zone under cracking conditions to produce hydrocarbon vapors and coke contaminated catalyst particles, separating said hydrocarbon vapors from the coke contaminated catalyst particles, passing said cracked hydrocarbon vapors to a recovery zone, stripping said coke contaminated catalyst particles of residual hydrocarbon vapors in a stripping zone, passing the coke contaminated catalyst particles to a regeneration zone via a coke contaminated catalyst circuit containing a control riser, regenerating said coke contaminated catalyst in a regeneration zone, the catalyst circulation rate in said process being regulated by injecting variable amounts of a control gas into said control riser, the improvement which comprises varying the pressure drop across the control riser within a range of from about 1 to about 3 psi by use of a valve means while maintaining the pressure differential between the regeneration zone and the cracking zone substantially constant and thereby varying said catalyst circulation rate.

2. The process of claim 1 wherein the control gas is air.

3. In a fluid catalytic cracking process which comprises contacting a hydrocarbon feedstock with a cracking catalyst in a cracking zone under cracking conditions to produce cracked hydrocarbon vapors and coke contaminated catalyst particles, separating said hydrocarbon vapors from the coke contaminated catalyst particles, passing said cracked hydrocarbon vapors to a recovery zone, stripping said coke contaminated catalyst particles of residual hydrocarbon vapors in a stripping zone, passing the coke contaminated catalyst particles to a regeneration zone via a coke contaminated catalyst circuit containing a control riser, regenerating said coke contaminated catalyst in a regeneration zone, the catalyst circulation rate in said process being regulated by injecting variable amounts of a control gas into said control riser, the improvement which comprises varying the temperature in the regeneration zone by use of a valve means so as to vary the pressure drop across said control riser within a range of from about 1 to about 3 psi and thereby varying the catalyst circulation rate while maintaining the pressure differential between the regeneration zone and the cracking zone substantially constant.

4. The process of claim 3 wherein the control gas is air.

* * * * *